US010081043B2

(12) United States Patent
Flehmig et al.

(10) Patent No.: US 10,081,043 B2
(45) Date of Patent: Sep. 25, 2018

(54) METHOD AND UPSETTING TOOL FOR PRODUCING HIGHLY DIMENSIONALLY ACCURATE HALF SHELLS

(71) Applicant: THYSSENKRUPP STEEL EUROPE AG, Duisburg (DE)

(72) Inventors: Thomas Flehmig, Ratingen (DE); Konstantinos Savvas, Oberhausen (DE)

(73) Assignee: THYSSENKRUPP STEEL EUROPE AG, Duisburg (DE)

( * ) Notice: Subject to any disclaimer, the term of this patent is extended or adjusted under 35 U.S.C. 154(b) by 368 days.

(21) Appl. No.: 14/783,936

(22) PCT Filed: Apr. 4, 2014

(86) PCT No.: PCT/EP2014/056824
§ 371 (c)(1),
(2) Date: Oct. 12, 2015

(87) PCT Pub. No.: WO2014/166839
PCT Pub. Date: Oct. 16, 2014

(65) Prior Publication Data

US 2016/0067757 A1 Mar. 10, 2016

(30) Foreign Application Priority Data

Apr. 10, 2013 (DE) ..... 10 2013 103 612

(51) Int. Cl.
*B21D 5/16* (2006.01)
*B21D 22/20* (2006.01)
(Continued)

(52) U.S. Cl.
CPC ..... *B21D 22/20* (2013.01); *B21D 5/16* (2013.01); *B21D 13/10* (2013.01); *B21D 22/00* (2013.01);
(Continued)

(58) Field of Classification Search
CPC ..... B21D 22/20; B21D 22/06; B21D 41/00; B21D 39/08; B21D 5/16; B21D 13/10; B21D 22/00; B21D 39/00; B30B 15/00
(Continued)

(56) References Cited

U.S. PATENT DOCUMENTS 7,650,773 B2 * 1/2010 Shikano ..... B21D 22/06 29/889.72
8,528,376 B2 * 9/2013 Li ..... B22D 17/22 29/421.1
(Continued)

FOREIGN PATENT DOCUMENTS

CN 202212478 U 5/2012
CN 102665956 A 9/2012
(Continued)

OTHER PUBLICATIONS

German Language International Search Report for International patent application No. PCT/EP2014/056824; dated May 30, 2014.
(Continued)

*Primary Examiner* — David B Jones
(74) *Attorney, Agent, or Firm* — thyssenkrupp North America, Inc.

(57) ABSTRACT

The invention relates to a method for producing highly dimensionally accurate, deep-drawn half shells having a bottom region, a jacket and optionally having a flange, wherein a half shell pre-formed from a blank is formed into a finished half shell, wherein the pre-formed half shell has excess blank material on account of its geometrical shape, and the half shell being upset by way of at least one pressing operation in an upsetting tool to form the finished half shell during the forming of the pre-formed half shell into its finished shape on account of the excess blank material. The object of specifying a method and an apparatus, by way of which the process reliability can be increased during the
(Continued)

production of a half shell, is achieved by way of the abovementioned method by virtue of the fact that the size of the upset gap is reduced during the closing of the upsetting tool to the actual wall thickness of the jacket of the preformed half shell. In addition, the object is achieved by way of an upsetting tool according to the invention by virtue of the fact that two side walls are provided which, together with the bottom region of the die of the second tool half, form a corresponding die, and the side walls can be displaced perpendicularly or obliquely with respect to the movement direction of the die.

14 Claims, 5 Drawing Sheets

(51) Int. Cl.

| | |
|---|---|
| ***B21D 13/10*** | (2006.01) |
| ***B21D 39/08*** | (2006.01) |
| ***B21D 39/00*** | (2006.01) |
| ***B21D 22/00*** | (2006.01) |
| ***B21D 41/00*** | (2006.01) |
| ***B30B 15/00*** | (2006.01) |
| ***B21D 22/06*** | (2006.01) |

(52) U.S. Cl.
CPC ..... *B21D 22/06* (2013.01); *B21D 39/00* (2013.01); *B21D 39/08* (2013.01); *B21D 41/00* (2013.01); *B30B 15/00* (2013.01)

(58) Field of Classification Search
USPC ..... 72/349, 375, 475
See application file for complete search history.

(56) References Cited

U.S. PATENT DOCUMENTS

| | | | | |
|---|---|---|---|---|
| 8,726,801 | B2 * | 5/2014 | Asakawa | B21D 22/00 100/43 |
| 2009/0044592 | A1 | 2/2009 | Shikano et al. | |
| 2010/0126244 | A1 | 5/2010 | Chien | |
| 2010/0251796 | A1 * | 10/2010 | Akimoto et al. | B21F 1/00 72/375 |
| 2011/0132208 | A1 | 6/2011 | Asakawa et al. | |

FOREIGN PATENT DOCUMENTS

| | | | |
|---|---|---|---|
| DE | 3436313 | C2 | 10/1987 |
| DE | 4120404 | A1 | 12/1992 |
| DE | 4127848 | A1 | 2/1993 |
| DE | 102007059251 | A1 | 6/2009 |
| DE | 102008037612 | A1 | 6/2010 |
| WO | 2008/025387 | A1 | 3/2008 |
| WO | 2012/097812 | A1 | 7/2012 |

OTHER PUBLICATIONS

English translation of International Search Report for International patent application No. PCT/EP2014/056824; dated May 30, 2014.
English translation of abstract of DE 4120404 A1.
English translation of abstract of DE 102007059251 A1.
English translation of abstract of DE 102008037612 A1.
English language Abstract for DE 3436313 C2 listed above.
English language Abstract for DE 4127848 A1 listed above.
English language Abstract for CN 102665956 A listed above.

* cited by examiner

METHOD AND UPSETTING TOOL FOR PRODUCING HIGHLY DIMENSIONALLY ACCURATE HALF SHELLS

CROSS REFERENCE TO RELATED APPLICATIONS

This application is a U.S. National Stage Entry of International Patent Application Serial Number PCT/EP2014/056824, filed Apr. 4, 2014, which claims priority to German patent application no. DE 102013103612.0 filed Apr. 10, 2013, the entire contents of both of which are incorporated herein by reference.

FIELD

The invention relates to a method for producing highly dimensionally accurate, deep-drawn half shells having a bottom region, a jacket and optionally having a flange, wherein a half shell pre-formed from a blank is formed into a finished half shell, wherein the pre-formed half shell has excess blank material on account of its geometrical shape, and the half shell being upset by way of at least one pressing operation in an upsetting tool to form the finished half shell during the forming of the pre-formed half shell into its finished shape on account of the excess blank material. In addition, the invention relates to an upsetting tool for producing a highly dimensionally accurate, deep-drawn half shell, having at least a first and a second tool half, the first tool half having a header die, the shape of which corresponds to the inner contour of the finally shaped half shell, and the second tool half having a die, the die having a bottom region, the shape of which corresponds substantially to the bottom region and optionally the transition region to the jacket of the finally shaped half shell.

BACKGROUND

Closed hollow profiles are increasingly used in automotive engineering, which closed hollow profiles have cross sections and material thicknesses which are adapted specifically to the application. It is known to produce a closed hollow profile from two deep-drawn shells. To this end, the half shells, as described, for example, in German laid-open specification DE 41 20 404 A1, are first of all pre-formed and are subsequently calibrated in a post-forming step. It is problematical in the production of a hollow profile in this way that stresses are introduced into the blank during the deep-drawing operation, which stresses lead to springback of the half shells. The springback of the half shells makes it difficult, for example, to accurately position the half shells in a die for welding the half shells to form a closed hollow profile. Furthermore, half shells with pronounced springback cannot be used without additional work on account of the lack of dimensional accuracy. Various measures are known then from the prior art for avoiding a springback effect after the deep-drawing operation. A common feature of the measures known from the prior art, such as elongation of the component, provision of draw beads, partial hold-down control, tool adaptation measures or lubrication of the components, is that firstly complicated tools and drawing operations are used and secondly the stated measures show only limited success. Documents DE 10 2007 059 251 A1 and DE 10 2008 037 612 A1 have disclosed methods for producing half shells with low springback, the pre-formed half shell having excess material, with the result that the cross section is upset by way of a pressing operation to form the finished half shell during the forming of the preformed half shell into its finished shape. The stresses which are introduced into the blank material by way of the deep-drawing operation are oriented in this way, in order thus to counteract uncontrolled springback. In practice, however, the blanks do not always have a homogeneous thickness, as a result of which the material thickness of a half shell after the deep-drawing operation is subject to certain tolerances at least in the jacket region. By way of the above-described method, half shells which have the stated tolerances cannot be calibrated completely along their circumference, however. In particular in the region of the flange, if the latter is present, and in the region of the jacket, undesired corrugation formation occurs in the upset material during the upsetting operation, which corrugation formation firstly impairs the visual appearance of the half shell and secondly reduces the local dimensional accuracy. In addition, problems in the processing to form half shells with low springback can also arise on account of the springback of the pre-formed half shells and the associated lower dimensional accuracy of the pre-formed half shells. In the context of this application, the dimensional accuracy of a component is understood to mean a reduced tolerance in comparison with the conventional deep-drawing operation.

SUMMARY

An object of the present disclosure is to provide a method and an apparatus, by way of which the process reliability can be increased during the production of a half shell.

BRIEF DESCRIPTION OF THE DRAWINGS

The present disclosure is described in detail below with reference to the attached drawing figures, wherein.

DETAILED DESCRIPTION

Figure 1A:
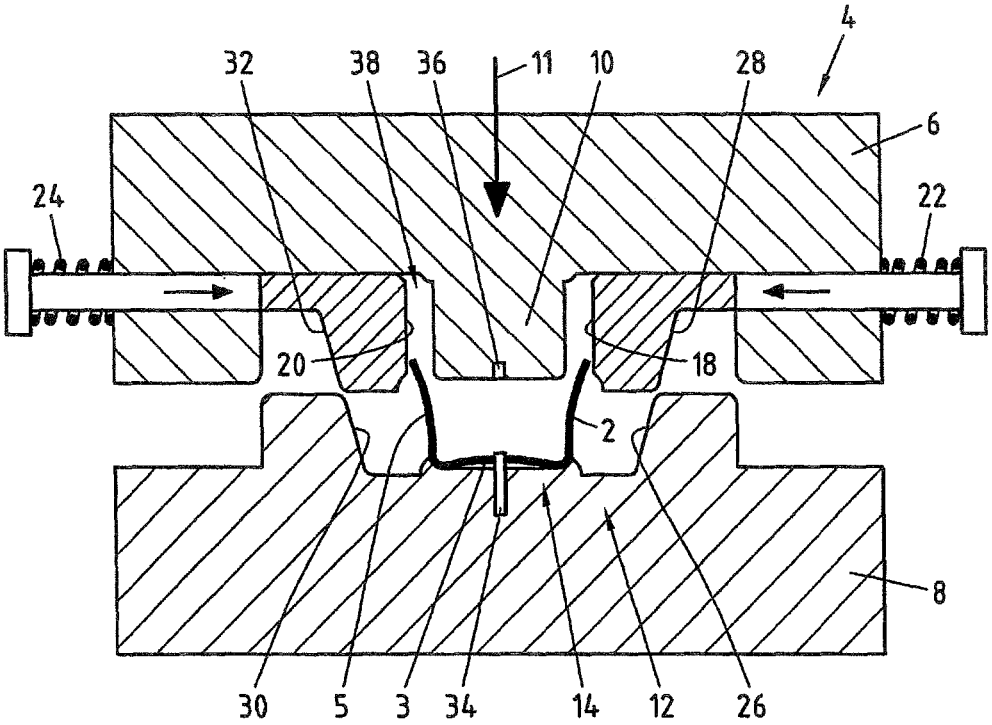
FIGS. 1*a*-1*c* are side cross section plan views of an embodiment of an upsetting tool of the present disclosure performing an embodiment of a method of the present disclosure.

Disclosed herein is a method and upsetting tool for producing a highly dimensionally accurate half shell in which the size of the upset gap is reduced during the closing of the upsetting tool to the actual wall thickness of the jacket of the pre-formed half shell. It has been recognized that half shells with springback and lower dimensional accuracy can also be brought to their end shape by way of the setting of the size of the upset gap to the actual dimension of the jacket of the pre-formed half shell. The size of the upset gap is preferably kept constant during the upsetting operation. Excess material can thus flow from the bottom region into the jacket, in particular during the upsetting operation, and can compensate for the stresses which are introduced into the preform as a result. The requirements made of the pre-forming of the half shells can be reduced considerably by way of the method according to the invention. As a consequence, the rejection rate of pre-formed half shells can be reduced, with the result that overall the process reliability of the production process of highly dimensionally accurate half shells can be increased.

According to a first refinement of the method according to the invention, the upsetting tool has a header die and a corresponding die, displaceable side walls being provided, via which the upset gap is set. The setting of the upset gap can be carried out in a particularly simple manner in this way. In order to prepare the upsetting operation, the pre-formed half shell is positioned in the corresponding die. In addition, it is also conceivable that the pre-formed half shell rests on the header die before the upsetting operation. During the upsetting operation, the header die is lowered in the corresponding die. The shape of the corresponding die corresponds to the outer shape of the finally formed half shell. The side walls of the upsetting tool are advantageously arranged in an open position with respect to one another at the beginning of the upsetting of a pre-formed half shell, that is to say they are at a maximum spacing from one another. While they are being brought together, the side walls move toward one another, as a result of which the upset gap between the header die and the side walls narrows. At the same time, the jacket of the half shell is brought into its final shape in this way. In the case in which the pre-formed half shell is arranged in the corresponding die, the header die is preferably moved into the inner shape of the pre-formed half shell at the same time as the movement of the side walls. Here, the shape of the header die corresponds to the inner contour of the finally formed half shell. However, the header die can also be moved into the interior of the half shell before or after closing of the side walls.

According to a further, preferred embodiment of the method according to the invention, the pre-formed half shell is oriented using centering and/or fixing means before being formed in the upsetting tool. The use of a reference point system (RPS) is particularly suitable for positioning the half shell, as a result of which an unambiguous and reproducible arrangement of the half shell in the upsetting tool can be achieved. To this end, what are known as reference points can be provided which guarantee accurate positioning and stabilization of the position of the half shell in the corresponding die or on the header die.

The orientation of the half shell preferably takes place using at least one centering pin, the pre-formed half shell having at least one corresponding centering opening. The at least one centering pin can be arranged in the corresponding die or else in the header die. The respective tool part which does not have the centering pin preferably has an opening for receiving the centering pin during the upsetting operation. In addition, the pre-formed half shell also has a corresponding opening for leading through at least one centering pin, with the result that the half shell can be positioned in the tool in such a way that a displacement out of the target position into an undefined position is prevented. As a result, the process reliability of the upsetting operation can be improved further by way of the accurate positioning of the preshaped half shell.

According to a further preferred embodiment, the upsetting tool has at least two centering means, preferably two centering pins and two corresponding centering openings. In this case, the pre-formed half shell likewise has two centering openings for leading through the centering pins, with the result that the stabilization of the position of the half shell can be improved further. It is conceivable to arrange both centering pins in the header die or in the corresponding die or to arrange in each case one centering pin in one tool part. It is advantageous, furthermore, if the upsetting tool has more than two centering means for stabilizing the position of the pre-formed half shell. In addition to the configuration as a centering pin, the centering means can also be configured as an alternative or in addition, for example, as an elevation, for example in the form of a cone, in the die or in the header die. The pre-formed half shell then has a depression for receiving said elevation, as a result of which the position of the half shell can likewise be stabilized. In this case, accurate positioning of the position of the pre-formed half shell in the upsetting tool can be achieved, it being possible for the presence of a centering opening for receiving the centering means in the upsetting tool to be dispensed with.

According to a further refinement of the method according to the invention, the upset gap is reduced slightly in the jacket region at least at the end of the upsetting operation. In the present case, a slight reduction is understood to mean a reduction by at most 5% of the actual wall thickness of the jacket. In this position, the different wall thicknesses in the jacket region are substantially equalized. The excess material is substantially impacted in the blank plane. As a result, in addition to the increase in the dimensional accuracy of the finally formed half shell, an improvement in the esthetics of the finished components is also achieved, with the result that the field of application of the finished half shells and/or hollow profiles can be extended considerably.

According to a further refinement of the method according to the invention, the gap in the bottom region and/or also in further regions of the finally formed component with horizontal components is reduced slightly by way of suitable means at the end of the upsetting operation. As a result, blank thickness fluctuations can be compensated for in the bottom and optionally in the flange region.

It is particularly preferred if the upset gap of the jacket is adapted to different wall thicknesses of the jacket by way of the displaceable side walls of the upsetting tool. The adaptation preferably takes place automatically by way of the exertion of a force on the side walls in the direction of the jacket of the half shell. Thus, if blank thickness fluctuations are present, the formation or enlargement of an upset gap between the upsetting tool and the jacket of the half shell can be prevented. According to said refinement, the method is self-regulating, since blank thickness fluctuations can be equalized automatically.

According to a further advantageous refinement of the method according to the invention, the pre-formed half shell is delimited axially by limiting means which are arranged at the axial ends. The limiting means are particularly preferably configured as slides which preferably already reach their end position at the beginning of the upsetting process. It is also conceivable, however, that the slides are moved into their end position during the upsetting process. An elongation of the half shell in the axial direction during the upsetting operation can thus be prevented. As a result, the presence of the axial limiting means contributes to the increase in the dimensional accuracy in the axial direction.

According to a second teaching of the present invention, the object mentioned at the outset is achieved by way of an upsetting tool having the features of patent claim 8. By virtue of the fact that the corresponding die of the upsetting tool has side walls which can be displaced perpendicularly or obliquely with respect to the movement direction of the header die, the size of the upset gap can be reduced particularly simply during closing of the upsetting tool to the actual wall thickness of the jacket of the pre-formed half shell. If the movement of the side walls takes place obliquely with respect to the movement direction of the header die, the movement preferably has a component in the direction parallel to the movement direction of the header die and a perpendicular component with respect to the movement direction of the header die. The adaptation of the upset gap has the advantage which has already been mentioned that half shells which are not dimensionally accurate can also be brought into their end shape, as a result of which the process reliability of the manufacturing process of highly dimensionally accurate half shells can be increased.

According to a first refinement of the upsetting tool according to the invention, the side walls are provided in the first or in the second tool half. The displaceable side walls can thus be connected particularly simply to the upsetting tool. It is also conceivable, however, that the displaceable side walls are connected neither to the first nor to the second tool half.

Furthermore, it is advantageous if the side walls are configured as slides which can be moved in the direction of the jacket of a half shell during the upsetting or after the upsetting of the half shell. The size of the upset gap can thus be set in a particularly simple way.

Active means are preferably provided, by way of which the side walls can be moved. It is conceivable, for example, to move the side walls using an electric, pneumatic or hydraulic drive. As an alternative, passive means can also be used, by way of which a movement of the side walls is forced.

The first or the second tool half preferably has means for positive guidance of the side walls as passive means. According to said embodiment, the abovementioned electric, pneumatic or hydraulic drive of the side walls can be dispensed with, a combination of one or more of said drives and positive guidance for movement of the side walls also being conceivable. The means for positive guidance of the side walls can be configured, for example, as a wedge-shaped sliding face on the upper and/or the lower tool half and/or the side walls. Here, the wedge-shaped faces are arranged in such a way that the side walls are moved in the direction of the jacket of the half shell as a result of the contact of the wedge-shaped faces of the side walls and the upper or lower tool half, for example during closing of the upsetting tool.

According to one preferred embodiment, means, in particular return springs, are provided, by way of which the side walls can be moved into their starting position again after the upsetting operation. This simplifies the removal of the finished half shell after the upsetting. In addition, the upsetting tool is immediately available for the following upsetting process.

According to a further preferred refinement of the upsetting tool according to the invention, the bottom region of the upsetting die and/or the header die have/has means for orienting the pre-formed half shell, in particular at least one centering pin. Both the bottom region of the upsetting die or the header die, if it has no centering pin, and the pre-formed half shell have a centering opening, with the result that unambiguous and reproducible positioning and stabilization of the position of the half shell in the corresponding die can be achieved using the reference point system (RPS). At least two centering means, in particular two centering pins, are preferably provided for orienting the preshaped half shell.

Furthermore, means for delimiting the axial ends of the half shell can be provided. Said means are preferably configured as slides which preferably already assume their end position at the beginning of the upsetting process. It is also conceivable, however, that the limiting means are moved into their end position during the upsetting process. An elongation of the half shell in the axial direction during the upsetting process is prevented by way of said limiting means.

In order to ensure the necessary strength, it is advantageous if the blank, from which the pre-formed half shell is manufactured, is composed of steel or a steel alloy. At the same time, the half shell has satisfactory forming properties. Finally, it is conceivable to heat the pre-formed half shell before the final forming.

Various embodiments of the present disclosure are discussed in further detail below with reference to the attached drawing figures.

Figure 1B:
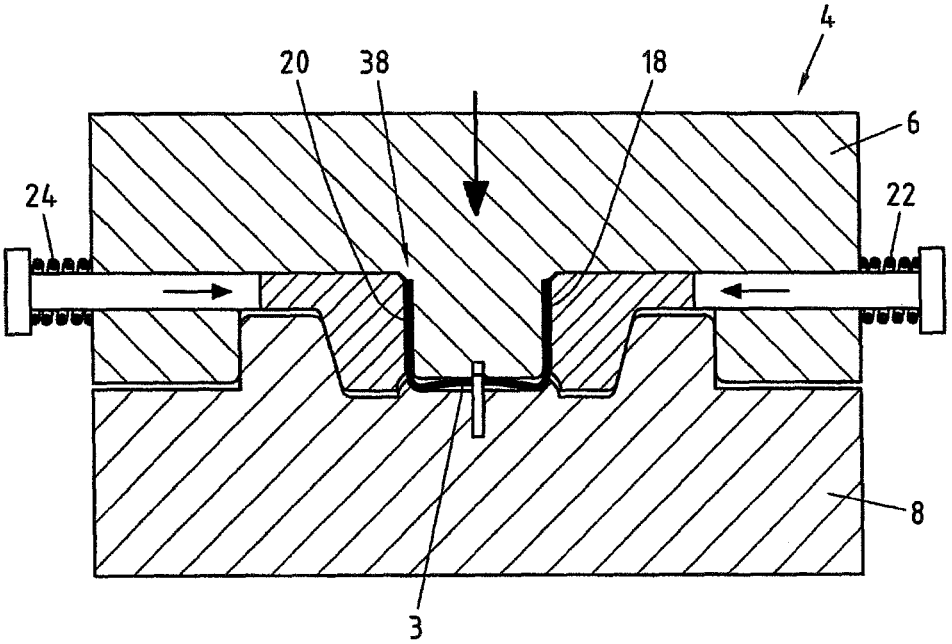
Figure 1C:
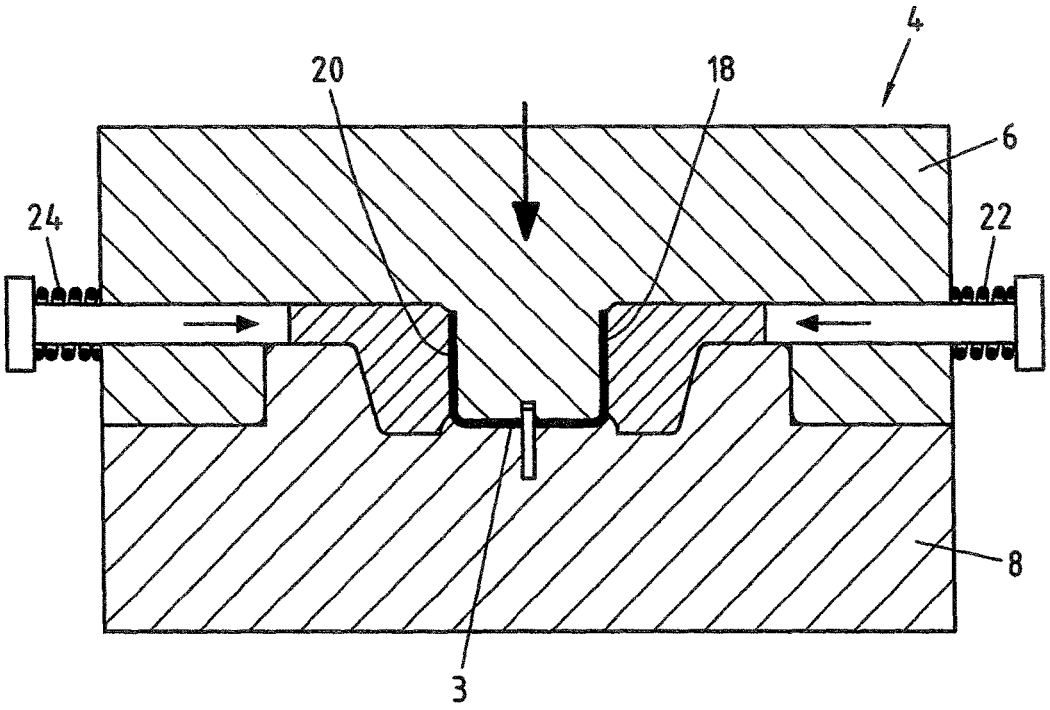

FIGS. 1*a* to 1*c* show a first exemplary embodiment of the method according to the invention for producing highly dimensionally accurate, deep-drawn half shells 2, the method being carried out using a first exemplary embodiment of an upsetting tool 4 according to the invention. A pre-formed half shell 2 which has a bottom region 3 and a jacket 5 is arranged in the upsetting tool 4. Furthermore, on account of its geometric shape, the pre-formed half shell 2 has excess blank material, by way of which the pre-formed half shell is upset into its final shape during the forming operation by way of a pressing operation which is shown in FIGS. 1*b* and 1 *c*. In the exemplary embodiment of the half shell 2 which is shown, the excess blank material is arranged substantially in the bottom region of the pre-formed half shell. To this end, the bottom region of the pre-formed half shell is slightly curved. The upsetting tool 4 has a first tool half 6 and a second tool half 8, the first tool half 6 having a header die 10, the shape of which corresponds to the inner contour of the finally formed half shell. The second tool half 8 has a die 12, the die 12 having a bottom region 14, the shape of which corresponds substantially to the bottom region and the transition region to the jacket of the finally formed half shell. During the upsetting process, the header die 10 is moved into the die 12, as indicated by the arrow 11.

Moreover, side walls 18, 20 are provided on the first tool half 6, which side walls 18, 20 form a corresponding die with the bottom region of the die 12 of the second tool half 8 in the closed state of the upsetting tool. The side walls 18, 20 can be displaced perpendicularly with respect to the movement direction of the header die 10. As an alternative and in a manner which is not shown here, the side walls can also be configured such that they can be fed in obliquely. In this way, the size of the upset gap 38 can be set in a particularly simple manner. The adaptation of the upset gap has the abovementioned effect that half shells which are not dimensionally accurate can also be finally shaped.

In the exemplary embodiment which is shown, the side walls 18, 20 are configured as slides which are moved in the direction of the jacket 5 of the half shell 2 during the upsetting. In addition, return springs 22, 24 are arranged on the side walls 18, 20, by way of which return springs 22, 24 the side walls 18, 20 are moved into their starting position again after the upsetting operation. The return springs 22, 24 are relieved in the open position (shown in FIG. 1*a*) of the upsetting tool. By way of the upsetting process which is shown in FIGS. 1*b* and 1*c*, the side walls 18, 20 being moved in the direction of the blank 5 of the half shell 2, the return springs are compressed and make a movement of the side walls 18, 20 into their starting position possible.

In the exemplary embodiment which is shown of the upsetting tool 2 according to the invention, the movement of the side walls 18, 20 takes place via a positive guidance means. To this end, both the side walls 18, 20 and the second tool half 8 have wedge-shaped flanks 26, 28, 30, 32 which bring about a movement of the side walls 18, 20 in the direction of the jacket 5 of the half shell 2 during closing the header die 10.

Finally, the die 12 has a centering pin 34, by way of which the half shell 2 can be positioned unambiguously and reproducibly in the die 12, if the half shell 2 has a corresponding centering opening. In addition, the header die 10 has a centering opening 36 for receiving the centering pin. The positioning of the half shell 2 in the die 12 can be improved considerably by way of the presence of the centering pin, as a result of which the process reliability of the manufacturing method of a highly dimensionally accurate half shell can be increased further.

FIGS. 1*a* to 1*c* now show the operation of upsetting the half shell. During the movement of the header die 10 into the corresponding die, the side walls 18, 20 are moved in the direction of the jacket 5 of the half shell 2 as a result of the positive guidance of the second tool half 8. As a result, the upset gap 38 narrows to the actual wall thickness of the jacket 5 of the half shell 2. FIG. 1*b* shows an intermediate position of the upsetting tool before final upsetting of the half shell, the header die 10 being lowered almost completely into the corresponding die. In FIG. 1*c*, the header die 10 is then lowered completely into the corresponding die, as a result of which the excess plate material of the half shell is upset and thus the final form of the half shell is generated. During the upsetting operation, the upset gap 38 is preferably kept constant. At the end of the upsetting operation, the upset gap 38 can optionally be reduced slightly, in order to compensate for any possible blank thickness fluctuations in the jacket 5. Via means which are not shown here, the gap in the bottom region can even be reduced slightly, in order to also equalize blank thickness fluctuations in said region.

FIGS. 2*a* to 2*d* show a second exemplary embodiment of the method according to the invention and the upsetting tool 40 according to the invention together with a pre-formed half shell 42. In contrast to the half shell which is shown in FIGS. 1*a* to 1*c*, the half shell 42 has a flange region 44. The second exemplary embodiment of the upsetting tool 40 according to the invention has a first tool half 46 and a second tool half 48, the first tool half 46 having a header die 50, the shape of which corresponds to the inner contour of the finally formed half shell. The second tool half 48 has a die 52, the die 52 having a bottom region 54, the shape of which corresponds substantially to the bottom region and the transition region to the jacket of the finally formed half shell. During the upsetting process, the header die 50 is moved into the die 52, as indicated by the arrow 56 and as has already been described above.

Moreover, side walls 56, 58 are provided on the second tool half 48, which side walls 56, 58 form a corresponding die with the bottom region of the die 52 of the second tool half 48 in the closed state of the upsetting tool. The side walls 56, 58 can be displaced perpendicularly or obliquely (not shown here) with respect to the movement direction of the header die 50. As a consequence, the gap can be reduced to the actual dimension of the jacket of the half shell during the upsetting operation, with the result that half shells which are not dimensionally accurate can also be finally formed. Moreover, thickness fluctuations of the jacket can be equalized by way of the movement of the side walls 56, 58, preferably after the upsetting process. As a result, corrugation formation of the upset material is effectively avoided, with the result that the process reliability of the manufacturing process can be increased overall.

In the exemplary embodiment which is shown, the side walls 56, 58 are configured as slides which are moved in the direction of the jacket of the half shell 42 during the upsetting. In addition, return springs 60, 62 are arranged on the side walls 56, 58, by way of which return springs 60, 62 the side walls 56, 58 are moved into their starting position again after the upsetting operation.

In the exemplary embodiment which is shown of the upsetting tool 40 according to the invention, the movement of the side walls 56, 58 takes place via a positive guidance means. To this end, both the side walls 56, 58 and the first tool half 46 have wedge-shaped flanks 64, 66, 68, 70 which lead to a movement of the side walls 56, 58 in the direction of the blank of the half shell 42 during closing of the header die 50.

Finally, the die 52 has a centering pin 72, by way of which the half shell 42 can be positioned unambiguously and reproducibly in the die 52, if the half shell 42 has a corresponding centering opening. In addition, the header die 50 has a centering opening 74 for receiving the centering pin 72, the position of the centering opening 74 being adapted to the position of the centering pin 72. As has already been shown, the process reliability of the manufacture of highly dimensionally accurate half shells can be increased by way of the presence of the centering pin.

Figure 2A:
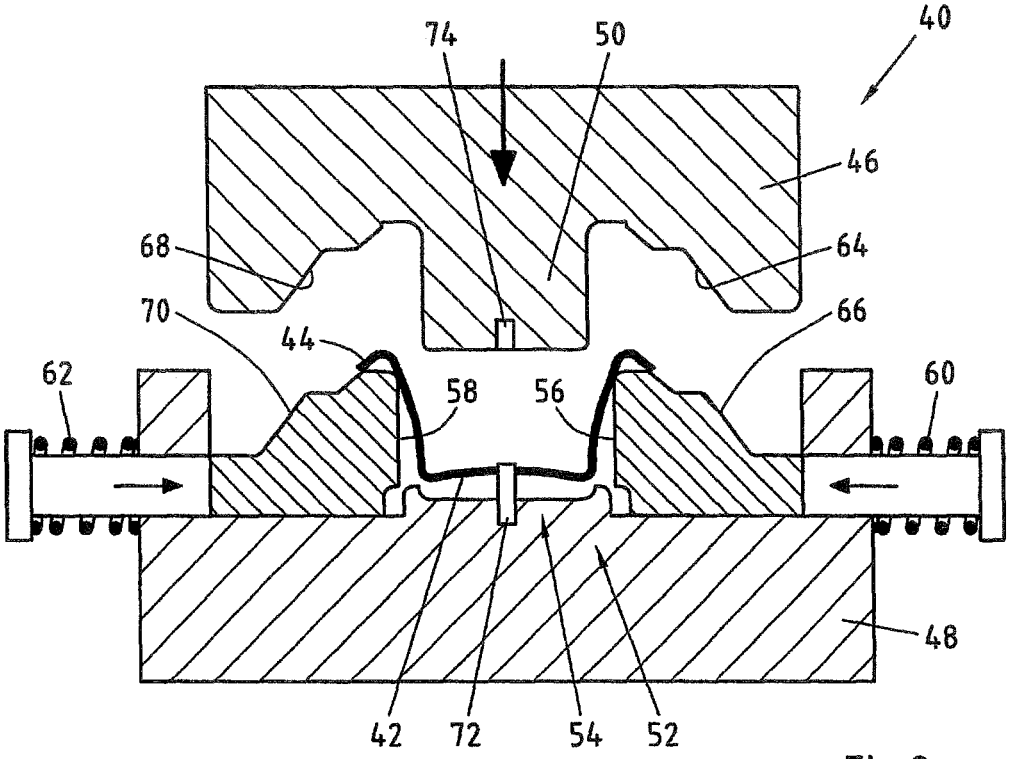
FIGS. 2*a*-2*d* are side cross section plan views of an alternate embodiment of an upsetting tool of the present disclosure performing an alternate embodiment of a method of the present disclosure.
Figure 2B:
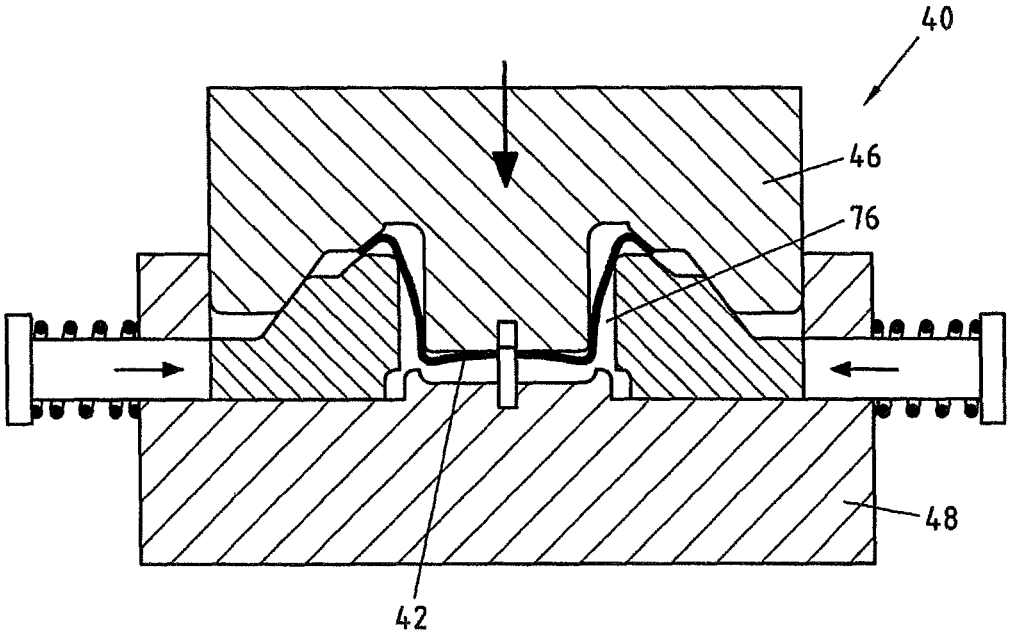
Figure 2C:
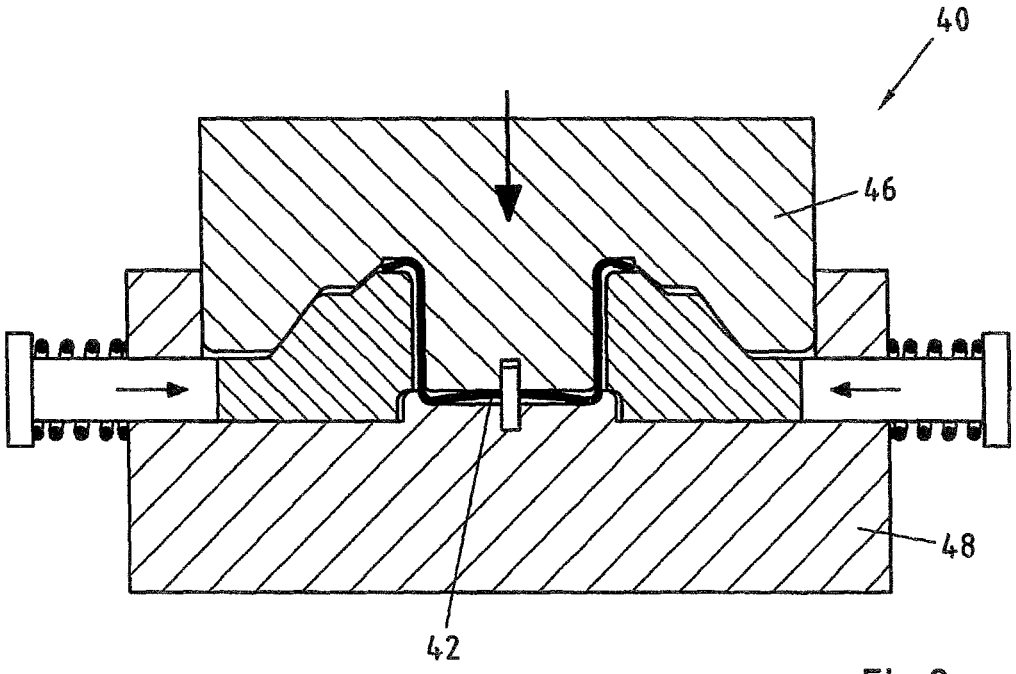
Figure 2D:
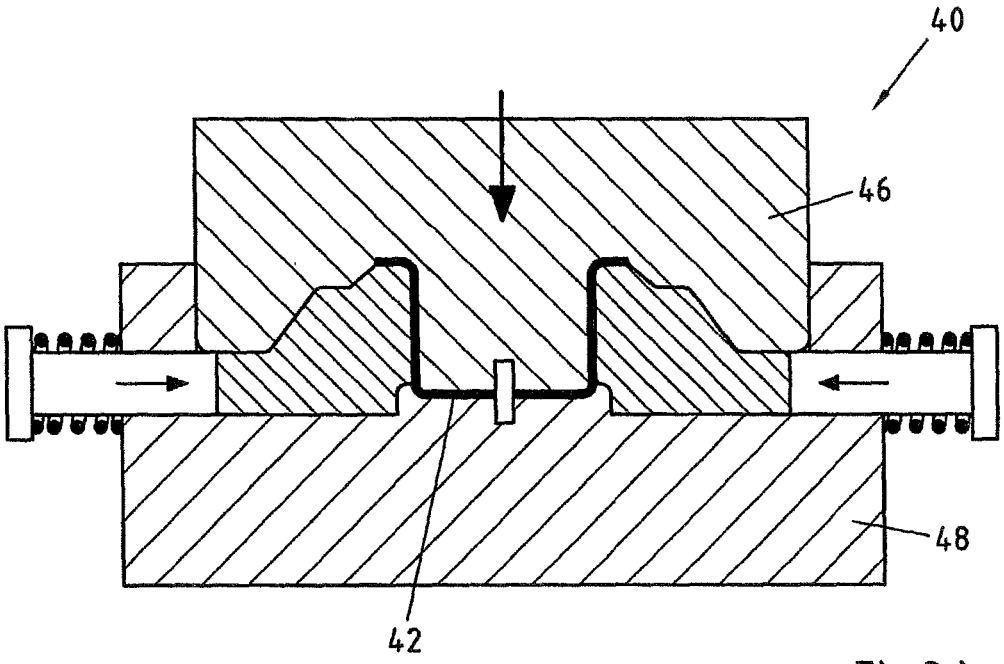

FIGS. 2*a* to 2*d* then show the operation of upsetting and final forming of the half shell 42. During the movement of the header die 50 into the corresponding die, the side walls 56, 58 are moved in the direction of the jacket of the half shell 42 as a result of the positive guidance of the first tool half 46 in an analogous manner to the exemplary embodiment which is shown in FIGS. 1*a* to 1*c*. As a result, the upset gap 76 narrows to the actual dimension of the jacket of the half shell 42. FIGS. 2*b* and 2*c* show intermediate positions of the upsetting tool before final upsetting, the header die 50 preferably being lowered into the corresponding die while the drawing gap is kept constant. In FIG. 2*d*, the header die 10 is now lowered completely into the corresponding die. By way of a flange braking operation, the excess blank material of the half shell is upset, as a result of which the end shape of the half shell 42 is generated.

Figure 3:
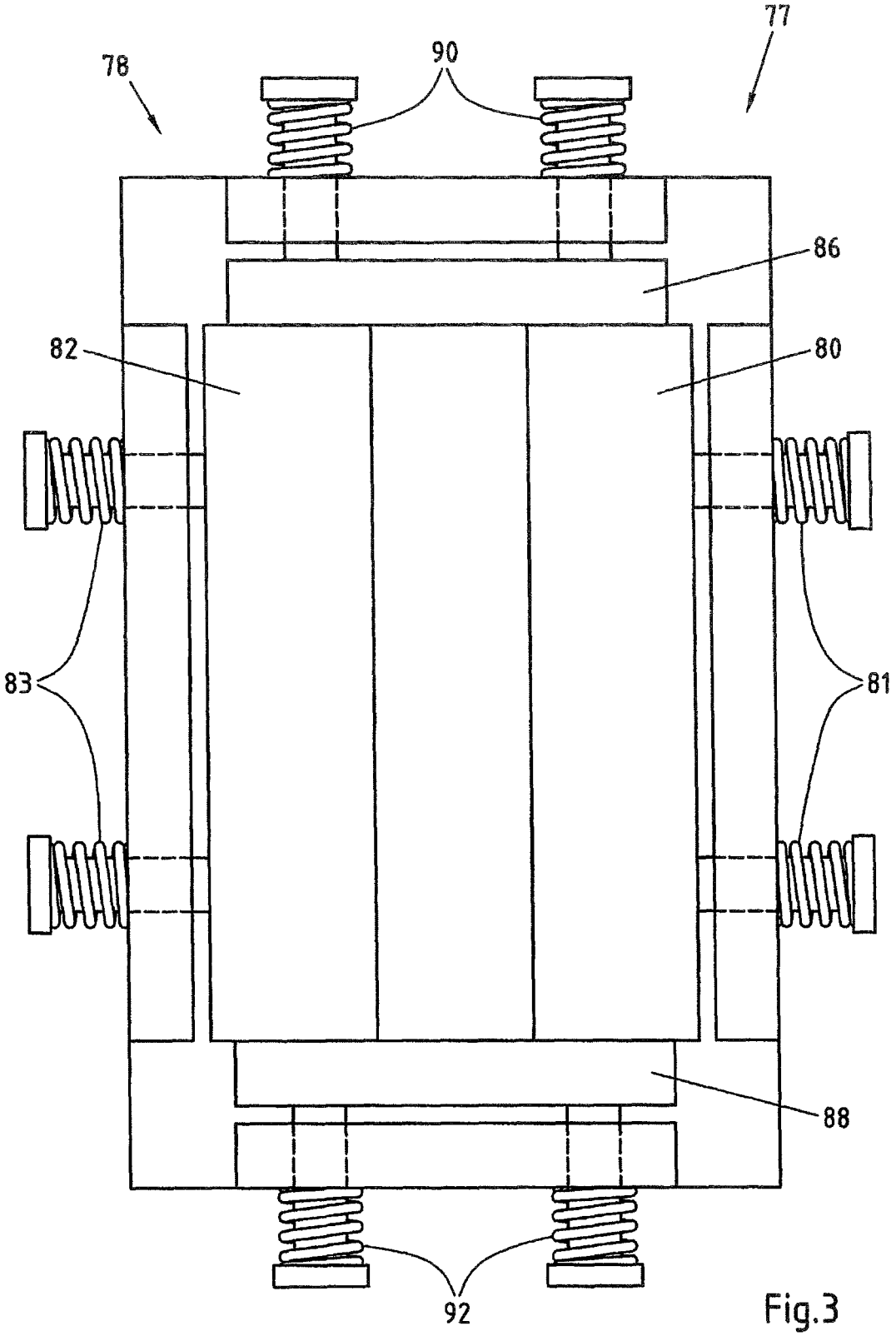
FIG. 3 is a plan view of an alternate embodiment of an upsetting tool of the present disclosure.

FIG. 3 shows a third exemplary embodiment of an upsetting tool 77 according to the invention in a schematic plan view. The exemplary embodiment which is shown of the upsetting tool 77 according to the invention has a first tool half and a second tool half 78, the first tool half not being shown. In accordance with the second exemplary embodiment of the upsetting tool according to the invention, side walls 80, 82 which are configured as slides are arranged on the second tool half 78. Moreover, return springs 81, 83 are provided which can move the side walls 80, 82 into their starting position after the upsetting.

Moreover, the exemplary embodiment which is shown of the upsetting tool according to the invention has means for axially delimiting the half shell 84. Said means are configured as slides 86, 88 which preferably already reach their final position at the beginning of the upsetting. By way of said limiting means, an elongation of the half shell in the axial direction during the upsetting process is prevented, as a result of which the dimensional accuracy of the finally formed half shells can be improved further. In the exemplary embodiment which is shown, the limiting means 86, 88 are likewise moved into their starting position after the upsetting by way of return springs 90, 92.

The invention claimed is:

1. A method for producing a highly dimensionally accurate, deep-drawn half shell having a bottom region and a jacket, the method comprising:

placing a pre-formed half shell, formed from a blank plate and having a jacket and excess blank material, into an upsetting tool including displaceable sidewalls;

closing the upsetting tool onto the pre-formed half shell;

during said closing step, reducing a size of an upset gap to an actual wall thickness of the jacket of the pre-formed half shell, wherein the displaceable sidewalls of the upsetting tool are adjusted to accommodate a specific wall thickness of the jacket of the pre-formed half shell;

upsetting the pre-formed half shell, by at least one pressing operation in the upsetting tool, to form a finished half shell.

2. The method of claim 1, wherein the upsetting tool includes a header die, a corresponding die, and the displaceable sidewalls by which the upset gap is set.

3. The method of claim 1, further comprising orienting the pre-formed half shell in the upsetting tool by at least one of a centering and fixing means, before said upsetting step.

4. The method of claim 3, wherein said orienting is step is performed by placing at least one centering opening defined in the pre-formed half shell onto at least one corresponding centering pin disposed in the upsetting tool.

5. The method of claim 1, wherein at an ending of said upsetting step, the upset gap in a region of the jacket of the half shell is reduced so as to effect a reduction in wall thickness of the jacket of the half shell, as compared to the actual wall thickness of the pre-formed half shell.

6. The method of claim 1, wherein the pre-formed half shell is delimited axially by limiting means of the upsetting tool disposed at axial ends of the upsetting tool.

7. An upsetting tool for producing highly dimensionally accurate, deep-drawn half shells, the upsetting tool comprising:

at least a first tool half including a header die having a shape corresponding to an inner contour of a fully formed half shell;

at least a second tool half including an upsetting die with a bottom region having a shape substantially corresponding to a bottom region of the fully formed half shell, said header die and said upsetting die configured to be moveable towards and away from each other in a first direction, so as to be able to cooperatively form a finished half shell therebetween during an upsetting operation;

two displaceable sidewalls that are moveable in a direction perpendicular to the first direction and are configured, together with the bottom region of the upsetting die of the second tool half, to form the sidewalls of at least one of the header die and the upsetting die, wherein the two displaceable sidewalls of the upsetting tool are adjusted to accommodate a specific wall thickness of a jacket of a pre-formed half shell.

8. The upsetting tool of claim 7, wherein said sidewalls are coupled to at least one of said first tool half and said second tool half.

9. The upsetting tool of claim 7, wherein said sidewalls are slides that can be moved in a direction of the jacket, at least one of during and after an upsetting operation.

10. The upsetting tool of claim 7, further comprising at least one of active and passive means operatively coupled to the sidewalls and configured to move said sidewalls.

11. The upsetting tool of claim 7, wherein at least one of said first tool half and said second tool half further includes means for positively guiding the sidewalls.

12. The upsetting tool of claim 7, further comprising return springs operatively coupled to said sidewalls and configured to bias said sidewalls so as to move said sidewalls into respective starting positions when said first tool half and said second tool half are moved away from each other, after completion of an upsetting operation.

13. The upsetting tool of claim 7, wherein at least one of said bottom region of said upsetting die and said header die further includes a means for orienting the pre-formed half shell between said header die and said upsetting die.

14. The upsetting tool of claim 7, further comprising a means for delimiting an axial end of the half shell operatively coupled to at least one of said first tool half and said second tool half.

* * * * *